US008988298B1

(12) United States Patent
Akhoondzadehasl et al.

(10) Patent No.: US 8,988,298 B1
(45) Date of Patent: Mar. 24, 2015

(54) COLLOCATED OMNIDIRECTIONAL DUAL-POLARIZED ANTENNA

(71) Applicant: QUALCOMM Incorporated, San Diego, CA (US)

(72) Inventors: Lida Akhoondzadehasl, La Jolla, CA (US); Allen Minh-Triet Tran, San Diego, CA (US); Mohammad Ali Tassoudji, Cardiff, CA (US); Donald Farrell Breslin, Sunnyvale, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/180,225

(22) Filed: Feb. 13, 2014

Related U.S. Application Data

(60) Provisional application No. 61/883,709, filed on Sep. 27, 2013.

(51) Int. Cl.
*H01Q 21/00* (2006.01)
*H01Q 9/04* (2006.01)

(52) U.S. Cl.
CPC ..... *H01Q 21/00* (2013.01)
USPC ..... 343/725; 343/700 MS

(58) Field of Classification Search
USPC ..... 343/700 MS, 725, 815, 817, 818, 833, 343/834, 835, 893
See application file for complete search history.

(56) References Cited

U.S. PATENT DOCUMENTS

| | | | | |
|---|---|---|---|---|
| 2,982,959 | A * | 5/1961 | Hanneken | 343/724 |
| 6,320,544 | B1 * | 11/2001 | Korisch et al. | 343/700 MS |
| 6,456,245 | B1 * | 9/2002 | Crawford | 343/702 |
| 6,489,925 | B2 | 12/2002 | Thursby et al. | |
| 7,129,897 | B2 * | 10/2006 | Iigusa et al. | 343/700 MS |
| 7,498,996 | B2 * | 3/2009 | Shtrom et al. | 343/795 |
| 2009/0007185 | A1 | 1/2009 | Nix et al. | |
| 2009/0219215 | A1 | 9/2009 | Huber et al. | |
| 2012/0050129 | A1 | 3/2012 | Kanazawa et al. | |
| 2012/0169543 | A1 | 7/2012 | Sharma et al. | |
| 2013/0135150 | A1 | 5/2013 | Kenoun et al. | |

OTHER PUBLICATIONS

U.S. Appl. No. 13/947,980, filed Jul. 22, 2013, Tran et al.

* cited by examiner

*Primary Examiner* — Hoang V Nguyen
*Assistant Examiner* — Patrick Holecek
(74) *Attorney, Agent, or Firm* — Mahamedi Paradice LLP

(57) ABSTRACT

An antenna structure is disclosed that includes a first antenna extending from a substrate, a second antenna formed on the substrate, and first and second parasitic elements formed on the substrate. The first antenna provides an omni-directional radiation pattern in the azimuth plane for vertically polarized signals, and the second antenna provides an omni-directional radiation pattern in the azimuth plane for horizontally polarized signals. The parasitic elements absorb and re-radiate electromagnetic waves radiated from the second antenna.

23 Claims, 9 Drawing Sheets

Phi / Degree vs. dBi @ 5.1 GHz

Phi / Degree vs. dBi @ 5.1 GHz

Phi / Degree vs. dBi @ 5.5 GHz

Phi / Degree vs. dBi @ 5.5 GHz

Phi / Degree vs. dBi @ 5.9 GHz

Phi / Degree vs. dBi @ 5.9 GHz

COLLOCATED OMNIDIRECTIONAL DUAL-POLARIZED ANTENNA

CROSS-REFERENCE TO RELATED APPLICATION

This application claims the benefit under 35 USC 119(e) of the commonly owned U.S. Provisional Application No. 61/883,709 entitled "COLLOCATED OMNIDIRECTIONAL DUAL-POLARIZED ANTENNA" filed on Sep. 27, 2013, the entirety of which is incorporated by reference herein.

TECHNICAL FIELD

The present embodiments relate generally to antennas, and specifically to antennas that provide polarization diversity, radiation diversity, and spatial diversity.

BACKGROUND OF RELATED ART

Wireless communication devices, such as access points (APs) and/or mobile stations (STAs), may employ multiple-input and multiple-output (MIMO) technology to improve data throughput, to improve channel conditions, and/or to increase range. In general, MIMO may refer to the use of multiple antennas in a wireless device to achieve antenna diversity. Antenna diversity may allow the wireless device to transmit and/or receive signals from a set of multiple paths through the wireless channel, which in turn may reduce the impact of multipath interference and increase channel diversity, for example, to provide well-conditioned wireless channels.

Antenna diversity may be achieved by providing polarization diversity, pattern diversity, and/or spatial diversity. Polarization diversity may be achieved by using multiple antennas with different polarizations to transmit or receive radio frequency (RF) signals. For example, a horizontally polarized antenna may be used to transmit and receive horizontally polarized signals, and a vertically polarized antenna may be used to transmit and receive vertically polarized signals. It is noted that a horizontally polarized antenna may not harvest sufficient energy from vertically polarized signals to successfully receive the vertically polarized signals, and a vertically polarized antenna may not harvest sufficient energy from horizontally polarized signals to successfully receive the horizontally polarized signals.

Pattern diversity may be achieved by using multiple antennas, each having a unique radiation pattern and/or radiation direction, to transmit or receive RF signals. More specifically, to achieve omni-directional signal transmission and reception coverage, multiple antennas may be positioned in different directions so that their corresponding radiation patterns are oriented in different directions. For example, a horizontally positioned dipole antenna and a vertically positioned dipole antenna may be arranged in a "cross" configuration to provide an omni-directional radiation pattern. However, because the horizontally positioned dipole antenna has a figure-8 radiation pattern in the azimuth plane, cross-dipole antennas may not provide omni-directional signal coverage in the azimuth plane for horizontally polarized signals. As a result, cross dipole antennas may not be suitable for use in WLAN applications (e.g., in access points and mobile stations) for which omni-directional signal coverage in the azimuth plane is desired for different polarization angles. Similarly, because the vertically positioned dipole antenna has a figure-8 radiation pattern in the vertical plane, cross-dipole antennas may not provide omni-directional signal coverage in the vertical plane vertically polarized signals.

Spatial diversity may be achieved by spacing the multiple antennas apart from one another. Due to the small size and form factor of many wireless devices (e.g., APs and STAs), spatial diversity may be difficult to achieve in such wireless devices.

Thus, there is a need for a compact antenna structure that provides omni-directional coverage in the azimuth plane for signals of various (e.g., horizontal and vertical) polarizations.

SUMMARY

This Summary is provided to introduce in a simplified form a selection of concepts that are further described below in the Detailed Description. This Summary is not intended to identify key features or essential features of the claimed subject matter, nor is it intended to limit the scope of the claimed subject matter.

An antenna structure is disclosed that provides polarization diversity at all angles on the horizon (e.g., in the azimuth plane of the Earth) while occupying less space than conventional antenna structures having orthogonally positioned antennas (e.g., cross dipole antennas). For some embodiments, the antenna structure includes a first antenna, a second antenna, a first parasitic element, and a second parasitic element. The first and second parasitic elements may be formed on opposite sides of a surface of a substrate. The first antenna, which is mounted on the first parasitic element and extends from the substrate in a vertical direction, may provide an omni-directional radiation pattern in the azimuth plane for vertically polarized signals. The second antenna, which is formed on the substrate and positioned between the first and second parasitic elements (e.g., such that the second antenna, the first parasitic element, and the second parasitic element are co-planar with respect to the substrate), may provide an omni-directional radiation pattern in the azimuth plane for horizontally polarized signals. Accordingly, the antenna structure may provide an omni-directional radiation pattern, in the azimuth plane, that includes both horizontal polarization and vertical polarization at all angles of incidence on the horizon.

For some embodiments, the first parasitic element may serve as a ground plane of the first antenna, and both the first and second parasitic elements may be magnetically coupled to the second antenna while being electrically isolated from the second antenna. For at least some embodiments, the first and second parasitic elements may absorb and re-radiate electromagnetic waves emanated from the second antenna, for example, in a manner that may operate to fill nulls in the radiation pattern of the second antenna that lie alongside the first and second parasitic elements.

The second antenna may include first and second radiating elements formed on opposite surfaces of the substrate. For at least some embodiments, the first radiating element may include a first pair of substantially L-shaped radiating bodies electrically coupled to each other at a first terminal of the second antenna, and the second radiating element may include a second pair of substantially L-shaped radiating bodies electrically coupled to each other at a second terminal of the second antenna. For at least one embodiment, the first and second radiating bodies may be positioned such that ends of the first pair of substantially L-shaped radiating bodies do not overlap ends of the second pair of substantially L-shaped radiating bodies.

As described in more detail below, wireless devices such as APs and STAs that employ antenna structures of the present embodiments may transmit/receive both vertically polarized signals and horizontally polarized signals to/from any angle on the horizon using less antenna space than conventional antenna structures that include orthogonally positioned antenna elements.

BRIEF DESCRIPTION OF THE DRAWINGS

The present embodiments are illustrated by way of example and are not intended to be limited by the figures of the accompanying drawings, where.

Like reference numerals refer to corresponding parts throughout the drawings.

DETAILED DESCRIPTION

Figure 1A:
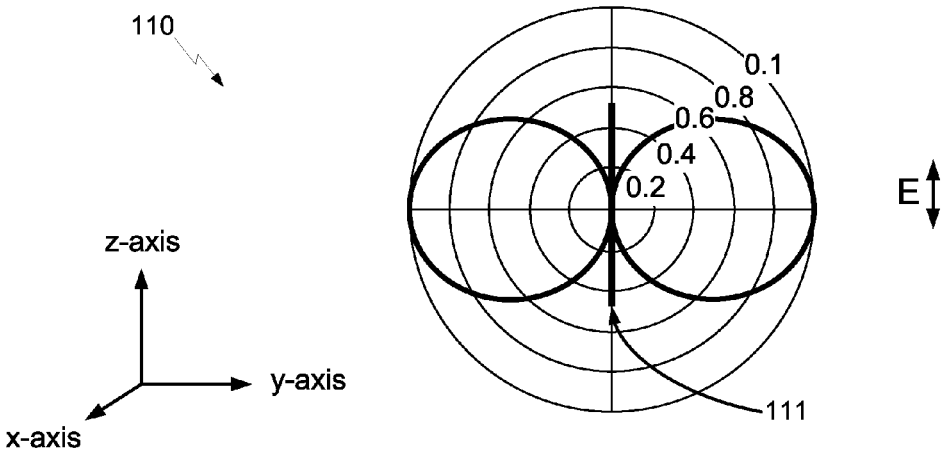
FIG. 1A depicts a radiation pattern of a vertically polarized dipole antenna.

The present embodiments are discussed below in the context of antenna structures for WLAN devices for simplicity only. It is to be understood that the present embodiments are equally applicable to other wireless communication technologies and/or standards. In the following description, numerous specific details are set forth such as examples of specific components, circuits, and processes to provide a thorough understanding of the present disclosure. The term "coupled" as used herein means connected directly to or connected through one or more intervening components or circuits. Also, in the following description and for purposes of explanation, specific nomenclature is set forth to provide a thorough understanding of the present embodiments. However, it will be apparent to one skilled in the art that these specific details may not be required to practice the present embodiments. In other instances, well-known circuits and devices are shown in block diagram form to avoid obscuring the present disclosure. The present embodiments are not to be construed as limited to specific examples described herein but rather to include within their scopes all embodiments defined by the appended claims.

The terms "horizontal plane" and "azimuth plane," as used herein, are interchangeable and refer to the two-dimensional plane parallel to the surface of the Earth (e.g., as defined by an x-axis and a y-axis). The term "vertical plane," as used herein, refers to a two-dimensional plane perpendicular to the horizontal plane (e.g., symmetrical about a z-axis).

The term "radiation pattern," as used herein, refers to a geometric representation of the relative electric field strength as emitted by a transmitting antenna at different spatial locations. For example, a radiation pattern may be represented pictorially as one or more two-dimensional cross sections of the three-dimensional radiation pattern. Because of the principle of reciprocity, it is known that an antenna has the same radiation pattern when used as a receiving antenna as it does when used as a transmitting antenna. Therefore, the term radiation pattern is understood herein to also apply to a receiving antenna, where it represents the relative amount of electromagnetic coupling between the receiving antenna and an electric field at different spatial locations. Thus, the term "omni-directional radiation pattern in the azimuth plane," as used herein, means a radiation pattern that covers all angles of incidence on the horizon.

The term "polarization," as used herein, refers to a spatial orientation of the electric field produced by a transmitting antenna, or alternatively the spatial orientation of electrical and magnetic fields causing substantially maximal resonance of a receiving antenna. For example, in the absence of reflective surfaces, a dipole antenna radiates an electric field that is oriented parallel to the radiating bodies of the antenna. The term "horizontally polarized," as used herein, refers to electromagnetic waves (e.g., RF signals) associated with an electric field (E-field) that oscillates in the horizontal direction (e.g., side-to-side in the horizontal plane), and the term "vertically polarized," as used herein, refers to electromagnetic waves (e.g., RF signals) associated with an E-field that oscillates in the vertical direction (e.g., up and down in the vertical plane).

FIG. 1A shows a cross-sectional view of a radiation pattern 110 of a vertically polarized dipole antenna 111 that extends in a vertical direction along the z-axis. The radiation pattern 110 is a toroid that is symmetrical about the z-axis and is omni-directional in the horizontal plane (e.g., as defined by the x-axis and the y-axis). More specifically, the radiation pattern 110 has maximum gains in the horizontal plane and has nulls in the vertical direction extending from each end of antenna 111. As a result, antenna 111 may receive signals originating from the horizon, and may not receive signals originating from the vertical direction (e.g., because of the nulls extending from the axis of the antenna 111). Further, because antenna 111 is vertically polarized, antenna 111 may capture only the vertically polarized components of received signals. Thus, although antenna 111 has an omni-directional radiation pattern 110 in the horizontal plane, antenna 111 may not receive horizontally polarized signals originating from the horizon.

Figure 1B:
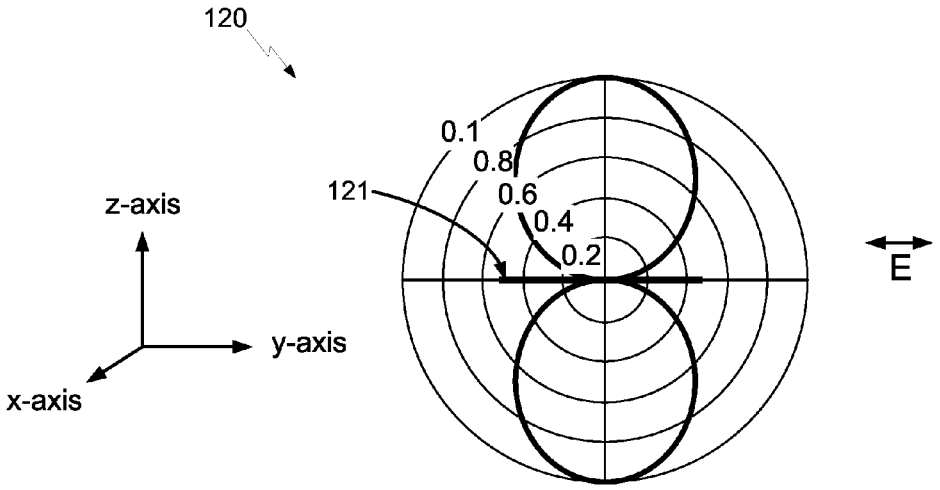
FIG. 1B depicts a radiation pattern of a horizontally polarized dipole antenna.

FIG. 1B shows a cross-sectional view of a radiation pattern 120 of a horizontally polarized dipole antenna 121 that extends in a horizontal direction (e.g., along the x-axis). The radiation pattern 120 is a toroid that is symmetrical about the y-axis and is omni-directional in the vertical plane. More specifically, the radiation pattern 120 has maximum gains in the vertical plane and has nulls in the horizontal direction extending from each end of antenna 121. As a result, antenna 121 may not receive signals originating from paths on the horizon along the x-axis. Further, because antenna 121 is horizontally polarized, antenna 121 may capture only the horizontally polarized components of received signals. Thus, although antenna 121 has an omni-directional radiation pattern 120 in the vertical plane, antenna 121 may not receive vertically polarized signals.

Thus, although the vertically polarized antenna 111 and the horizontally polarized antenna 121 may be arranged together in a cross-configuration, the resulting cross dipole antenna structure may not be able to transmit/receive horizontally polarized signals to/from all angles on the horizon (although it may be able to transmit/receive vertically polarized signals to/from all angles on the horizon).

Further, when multiple antennas having different polarizations are collocated on the same device, undesirable coupling between the multiple antennas may cause the multiple antennas to interfere with each other. For example, if antenna 111 of FIG. 1A and antenna 121 of FIG. 1B are adjacent to one another, then the vertically polarized antenna 111 may undesirably radiate some horizontally polarized signals (e.g., thereby interfering with the reception of horizontally polarized signals by the horizontally polarized antenna 121), and the horizontally polarized antenna 121 may undesirably radiate some vertically polarized signals (e.g., thereby interfering with the reception of vertically polarized signals by the vertically polarized antenna 111). Thus, when collocating multiple antennas on a wireless device, it is desirable to isolate the multiple antennas from each other.

Figure 2A:
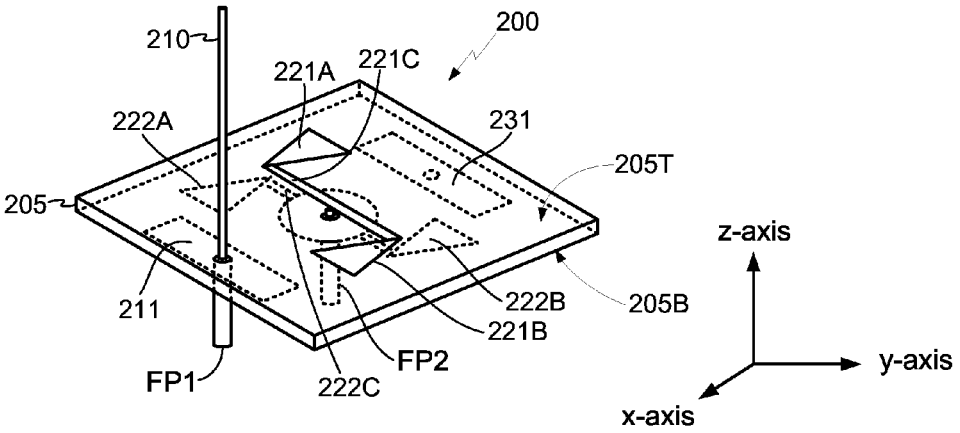
FIG. 2A shows an elevated perspective view of an antenna structure in accordance with some embodiments.
Figure 2B:
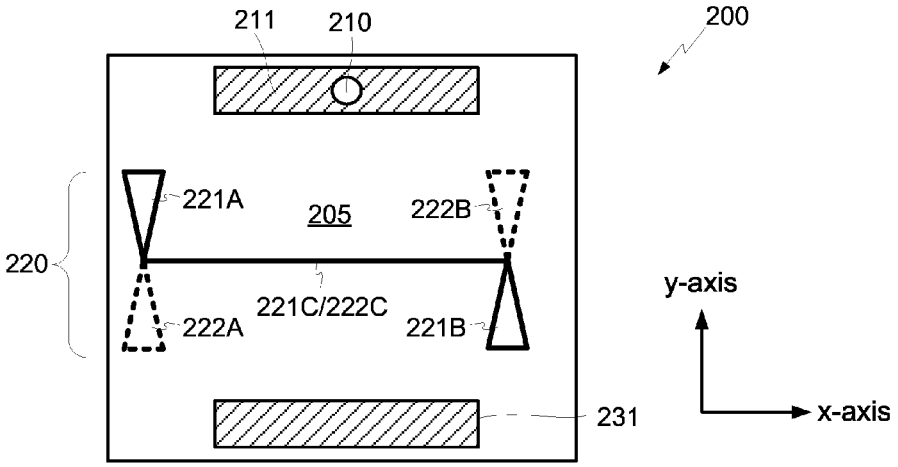
FIG. 2B shows a top plan view of the antenna structure of FIG. 2A in accordance with some embodiments.
Figure 2C:
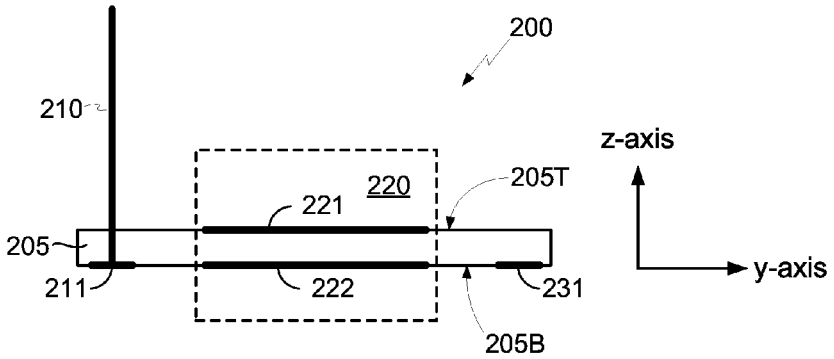
FIG. 2C shows a side cross-sectional view of the antenna structure of FIG. 2A in accordance with some embodiments.

FIGS. 2A-2C show an antenna structure 200 in accordance with some embodiments. The antenna structure 200, which may provide omni-directional coverage on the horizon (in the azimuth plane) for both vertically polarized signals and horizontally polarized signals, includes a first antenna 210, a second antenna 220, a first parasitic element 211, and a second parasitic element 231 mounted on a substrate 205. The substrate 205, which may be any suitable dielectric substrate such as a printed circuit board (PCB), is parallel to the azimuth plane (e.g., as defined by the x-axis and the y-axis). A first feed point FP1 and a second feed point FP2 may provide signals to be transmitted to and/or received from the first antenna 210 and the second antenna 220, respectively. For some embodiments, feed points FP1 and FP2 may be coax cables. For one such embodiment, the inner conductors of the coax cables may provide data signals to/from antennas 210 and 220, and the outer conductors of the coax cables may provide ground connections to antennas 210 and 220. For other embodiments, feed points FP1 and FP2 may be other suitable conductors that transmit electrical signals.

The first antenna 210, which may operate as a monopole antenna, is mounted over the first parasitic element 211. The first antenna 210 extends outwardly from the substrate 205 in the vertical direction (e.g., along the z-axis), and is perpendicular to the first parasitic element 211 (and thus perpendicular to the substrate 205). The first parasitic element 211 is formed on a surface of substrate 205 using a conductive material. For at least some embodiments, the first parasitic element 211 may act as a ground plane and/or as a reflecting surface for the first antenna 210 (e.g., in a manner that causes the radiation pattern of the first antenna 210 to resemble the radiation pattern of a dipole antenna). For such embodiments, the first feed point FP1 may include a positive terminal to provide signal connections to first antenna 210, and may include a negative terminal to provide ground connections to the first parasitic element 211. In this manner, the first antenna 210 and the first parasitic element 211 may operate together, for example, in a manner similar to a dipole antenna.

The first antenna 210 is vertically polarized, and may primarily radiate and/or absorb vertically polarized components of electromagnetic waves. The radiation pattern of the first antenna 210 is a toroid that is symmetrical about the z-axis and is omni-directional in the azimuth plane (e.g., as defined by the x-axis and the y-axis). Thus, the first antenna 210 provides omni-directional coverage on the horizon for vertically polarized signals.

The second antenna 220, which may exhibit at least some of the radiating characteristics of a cross-dipole antenna, includes a first radiating element 221 and a second radiating element 222. As shown in FIGS. 2A-2C, the first radiating element 221 is mounted on the top surface 205T of substrate 205, and the second radiating element 222 is mounted on a bottom surface 205B of substrate 205. In this manner, the first radiating element 221 and the second radiating element 222 are co-planer with respect to each other and to substrate 205, and are electrically isolated from one another by substrate 205. The first and second radiating elements 221 and 222 are oriented perpendicularly to the first antenna 210, for example, so that the second antenna 220 is oriented perpendicularly to the first antenna 210. The first radiating element 221 may be electrically coupled to a positive (signal) terminal of the second feed point FP2, and the second radiating element 222 may be electrically coupled to a negative (ground) terminal of the second feed point FP2.

For the exemplary embodiment shown in FIGS. 2A-2C, the first radiating element 221 and the second radiating element 222 may each be formed as a pair of co-joined substantially "L" shaped radiating bodies, where each of the four "L" shaped radiating bodies extends outwardly in the azimuth plane from the second feed point FP2. More specifically, the first radiating element 221 may include two end portions 221A-221B that extend perpendicularly from the main portion 221C of the first radiating element 221, thereby forming an "L" shape at each end of the first radiating element 221. Similarly, the second radiating element 222 may include two end portions 222A-222B that extend perpendicularly from the main portion 222C of the second radiating element 222, thereby forming an "L" shape at each end of the second radiating element 222. The main portion 221C of the first radiating element 221 is positioned in parallel with and substantially equidistant from the first and second parasitic elements 211 and 231, and the main portion 222C of the second radiating element 222 is positioned in parallel with and substantially equidistant from the first and second parasitic elements 211 and 231. As a result, the main portions 221C and 222C of the first and second radiating elements 221 and 222 are aligned with respect to each other, for example, so that the main portion 221C of the first radiating element 221 overlies the main portion 222C of the second radiating element 222.

For some embodiments, the first end portions 221A and 222A of corresponding radiating elements 221 and 222 extend in opposite directions (e.g., such that first end portions 221A and 222A do not overlap each other), and the second end portions 221B and 222B of corresponding radiating elements 221 and 222 extend in opposite directions (e.g., such that second end portions 221B and 222B do not overlap each other). Note that the main portions 221C and 222C of radiating elements 221 and 222 overlie each other. Further, for some embodiments, the end portions 221A-221B of first radiating element 221 and the end portions 222A-222B of second radiating element 222 may be of a "flared" shape (e.g., as depicted in FIGS. 2A and 2B) to increase the operational bandwidth of the second antenna 220. For other embodiments, the end portions 221A-221B and 222A-222B may be of other suitable shapes and/or orientations to provide different radiation patterns, different frequency bandwidths, and/or other desired characteristics.

The second antenna 220 is horizontally polarized, and thus may primarily radiate and/or absorb horizontally polarized components of electromagnetic waves. The radiation pattern of the second antenna 220 is symmetrical about the z-axis and is omni-directional in the azimuth plane (e.g., as defined by the x-axis and the y-axis). Thus, the second antenna 220 provides omni-directional coverage on the horizon for horizontally polarized signals.

The second parasitic element 231, which may be similar in size and shape to the first parasitic element 211, is formed on a surface of substrate 205 using a conductive material. For some embodiments, the first parasitic element 211 and the second parasitic element 231 are oriented in parallel with each other, and in parallel with the main portions 221C and 222C of radiating elements 221 and 222 (e.g., as depicted in FIGS. 2A and 2B). In this manner, the first and second parasitic elements 211 and 231 may be magnetically coupled to the first and second radiating elements 221 and 222 of the second antenna 220, and may be electrically isolated from the first and second radiating elements 221 and 222 of the second antenna 220. As a result, the first and second parasitic elements 211 and 231 may be excited and re-radiate electromagnetic waves radiated from the second antenna 220 in a manner that alters the radiation pattern of the second antenna 220. More specifically, the first and second parasitic elements 211 and 231 may operate to fill nulls in the radiation pattern of second antenna 220 that lie alongside the first and second parasitic elements 211 and 231, as described in more detail below with respect to FIGS. 3A-3B, 4A-4B, and 5A-5B.

The first antenna 210, the radiating elements 221-222 that form the second antenna 220, and the parasitic elements 211 and 231 may be formed using any suitable conductive material, and may be formed on substrate 205 using any suitable fabrication technique. For some embodiments, the first radiating element 221 may be a microstrip conductor printed onto or otherwise attached to the top surface 205T of substrate 205, and the second radiating element 222 may be a microstrip conductor printed onto or otherwise attached to the bottom surface 205B of substrate 205. Further, for some embodiments, the first parasitic element 211 may be a microstrip conductor printed onto or otherwise attached to the bottom surface 205B of substrate 205, and the second parasitic element 231 may be a microstrip conductor printed onto or otherwise attached to the bottom surface 205B of substrate 205. For other embodiments, the first and second parasitic elements 211 and 231 may be formed on the top surface 205T of substrate 205.

In accordance with the present embodiments, the first parasitic element 211 may operate not only as a ground plane for first antenna 210 but also to re-radiate electromagnetic waves radiated from the second antenna 220. In this manner, the first parasitic element 211 may form a portion of both the first antenna 210 and the second antenna 220. The ability to use the first parasitic element 211 as a portion of both the first antenna 210 and the second antenna 220 may reduce the area consumed by the antenna structure 200. In addition, by mounting the first antenna 210 over the first parasitic element 211 and positioning the first antenna 210 adjacent to the horizontally oriented second antenna 220, the cross-sectional area of antenna structure 200 is, at least in the azimuth plane, similar to the cross-sectional area of the second antenna 220. In this manner, the addition of the first antenna 210 to the second antenna 220 may allow for dual polarizations in the azimuth plane with minimal increase in cross-sectional area (e.g., as compared with only the second antenna 220).

The dimensions of the first antenna 210, the dimensions of the second antenna 220, and/or the dimensions of the parasitic elements 211 and 231 may be of any suitable values, and may be sized (e.g., with respect to an absolute scale and/or with respect to each other) to provide one or more desired antenna operating characteristics (e.g., operating frequencies, frequency responses, frequency bandwidths, antenna impedance, antenna gains, etc.). For some embodiments, a length of the first antenna 210 may be approximately equal to one-fourth of the wavelength of a desired operating frequency of the antenna structure 200, and a length of the radiating elements 221-222 of the second antenna 220 may be approximately equal to one-half of the wavelength of the desired operating frequency of the antenna structure 200.

As mentioned above, embodiments of the antenna structure 200 may provide omni-directional coverage in the azimuth plane for both horizontally polarized signals and vertically polarized signals. In this manner, the antenna structure 200 may be able to transmit/receive both vertically polarized signals and horizontally polarized signals to/from any direction in the azimuth plane without reduction in gain. Further, the relative position, orientation, size, and/or shapes of the conductors that form the first antenna 210, the first parasitic element 211, the first radiating element 221, the second radiating element 222, and the second parasitic element 231 may isolate the first and second antennas 210 and 220 from each other. In this manner, the first antenna 210 and the second antenna 220 may dominantly radiate or receive vertically and horizontally polarized signals, respectively. More specifically, by minimizing the cross polarization levels of the first antenna 210 and the second antenna 220, any relatively small horizontally polarized signals undesirably radiated from the first antenna 210 may minimally interfere with the second antenna 220's radiation of horizontally polarized signals, and any relatively small vertically polarized signals undesirably radiated from the second antenna 220 may minimally interfere with the first antenna 210's radiation of vertically polarized signals.

Figure 3A:
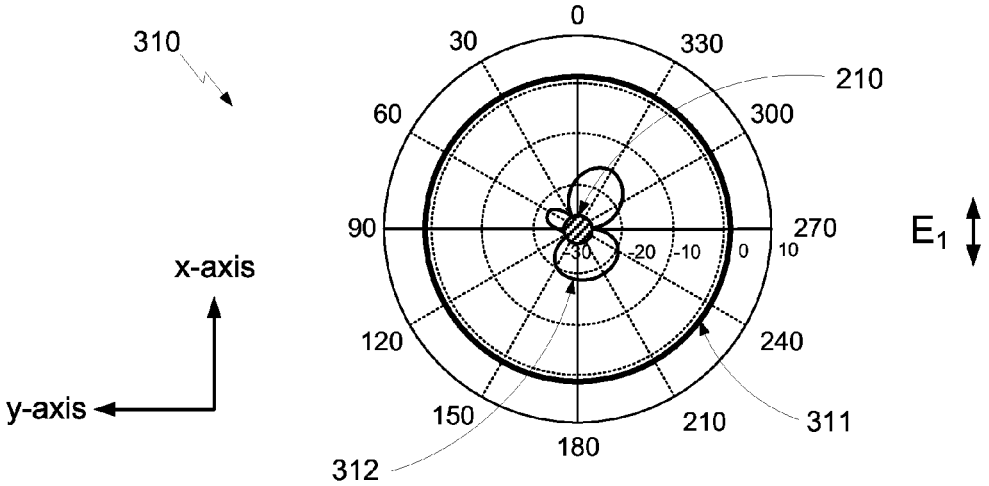
FIG. 3A depicts a radiation pattern of the first antenna of the antenna structure of FIGS. 2A-2C, at a first carrier frequency, in accordance with some embodiments.
Figure 3B:
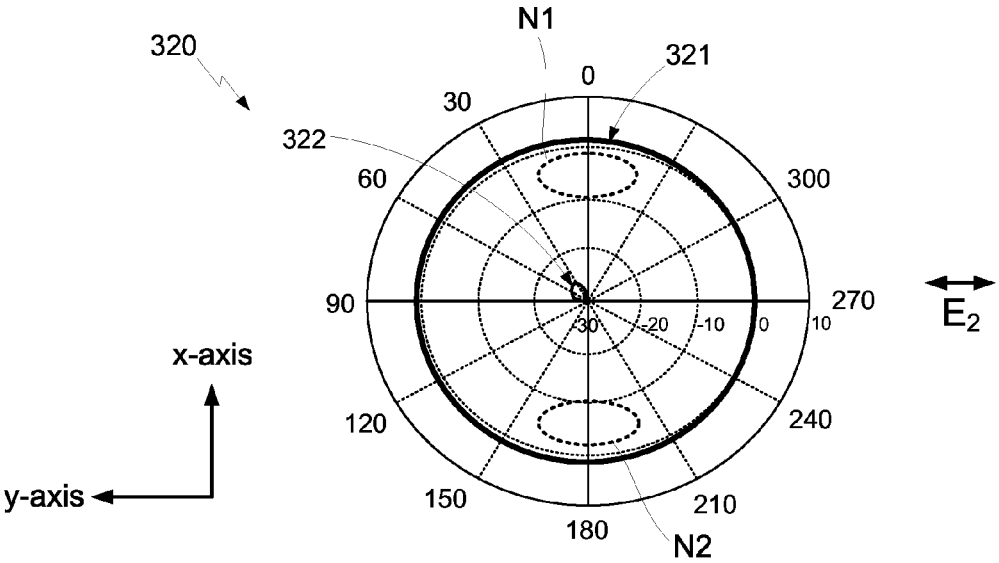
FIG. 3B depicts a radiation pattern of the first antenna of the antenna structure of FIGS. 2A-2C, at the first carrier frequency, in accordance with some embodiments.

For example, FIG. 3A shows a cross-sectional view of a radiation pattern 310 of the first antenna 210 associated with a first carrier frequency of approximately 5.1 GHz, and FIG. 3B shows a cross-sectional view of a radiation pattern 320 of the second antenna 220 associated with the first carrier frequency of approximately 5.1 GHz. The radiation pattern 310 of first antenna 210, which is vertically polarized and is depicted in FIG. 3A as extending outwardly from the azimuth plane (e.g., along the z-axis), includes a desired co-polar radiation pattern 311 and an undesirable cross-polar radiation pattern 312. The desired co-polar radiation pattern 311 is a toroid that provides omni-directional coverage in the azimuth plane (e.g., as defined by the x-axis and the y-axis) for vertically polarized signals ($E\Uparrow$). The undesired cross-polar radiation pattern 312 may be described as a figure-8 pattern in the azimuth plane having maximum gains along the x-axis and having minimum gains (e.g., nulls) along the y-axis. The isolation between the desired co-polar radiation pattern 311 and the undesirable cross-polar radiation pattern 312 may be on the order of approximately between 13-14 dB, thereby allowing the vertically polarized first antenna 210 to receive vertically polarized signals with minimal interference from any inadvertently received horizontally polarized signals.

The radiation pattern 320 of the second antenna 220, which is horizontally polarized and is co-planar with the azimuth plane (e.g., as defined by the x-axis and the y-axis), includes a desired co-polar radiation pattern 321 and an undesirable cross-polar radiation pattern 322. The desired co-polar radiation pattern 321 is a toroid that provides omni-directional coverage in the azimuth plane for horizontally polarized signals (E⇔ ). The undesired cross-polar radiation pattern 322 is a lobe at approximately 30 degrees. The isolation between the desired co-polar radiation pattern 321 and the undesirable cross-polar radiation pattern 322 may be on the order of approximately 18 dB, thereby allowing the horizontally polarized second antenna 220 to receive horizontally polarized signals with minimal interference from any inadvertently received vertically polarized signals.

By providing approximately 13-14 dB of isolation between the co-planar pattern 311 and the cross-planar pattern 312 of first antenna 210 and providing approximately 18 dB of isolation between the co-planar pattern 321 and the cross-planar pattern 322 of second antenna 220, the antenna structure 200 of FIGS. 2A-2C may allow for the concurrent transmission of a first data stream from first antenna 210 as vertically polarized signals and a second data stream from second antenna 220 as horizontally polarized signals (e.g., to achieve MIMO functionality).

As described above with respect to FIGS. 2A-2C, the parasitic elements 211 and 231 may be excited and re-radiate electromagnetic waves radiated from the second antenna 220 to compensate for nulls in the radiation pattern of the second antenna 220. For example, without the parasitic elements 211 and 231, the co-planar radiation pattern 321 of the second antenna 220 may include nulls N1 and N2 (or at least areas of reduced gains) on either side of the second antenna 220, as depicted in FIG. 3B. The presence of parasitic elements 211 and 231 may compensate for nulls N1 and N2 by absorbing and re-radiating electromagnetic waves radiated from the second antenna 220, thereby resulting in the omni-directional radiation pattern 321 shown in FIG. 3B.

Figure 4A:
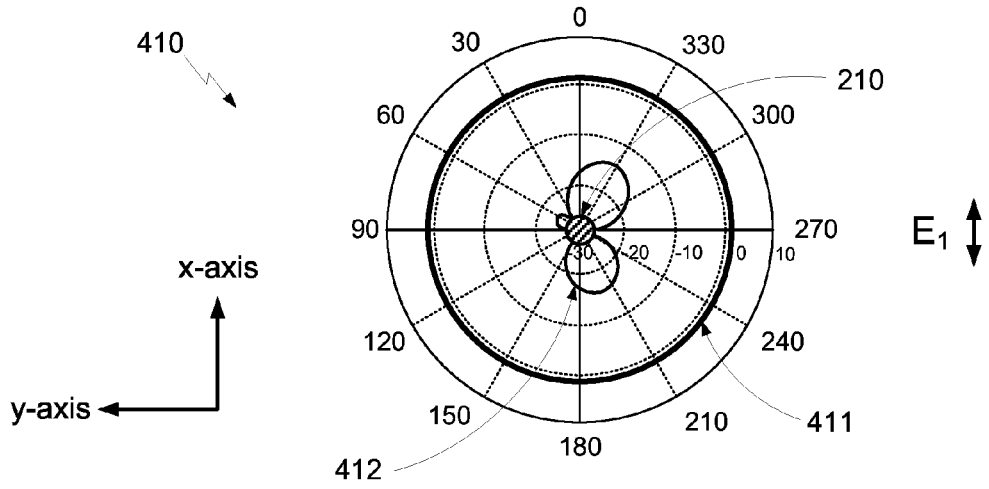
FIG. 4A depicts a radiation pattern of the first antenna of the antenna structure of FIGS. 2A-2C, at a second carrier frequency, in accordance with some embodiments.
Figure 4B:
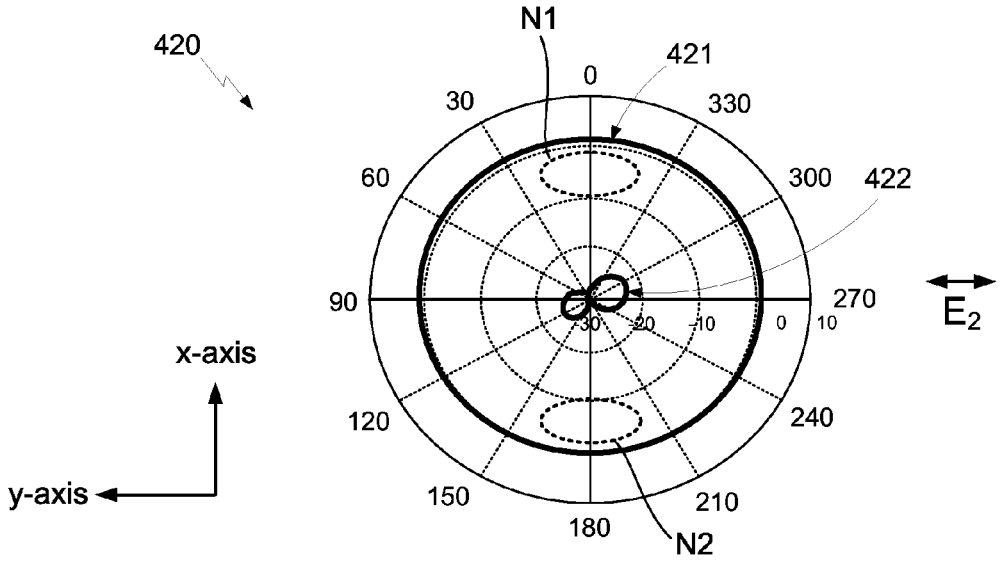
FIG. 4B depicts a radiation pattern of the first antenna of the antenna structure of FIGS. 2A-2C, at the second carrier frequency, in accordance with some embodiments.

FIG. 4A shows a cross-sectional view of a radiation pattern 410 of the first antenna 210 associated with a second carrier frequency of approximately 5.5 GHz, and FIG. 4B shows a cross-sectional view of a radiation pattern 420 of the second antenna 220 associated with the second carrier frequency of approximately 5.5 GHz. The radiation pattern 410 of first antenna 210, which is vertically polarized and is depicted in FIG. 4A as extending outwardly from the azimuth plane (e.g., along the z-axis), includes a desired co-polar radiation pattern 411 and an undesirable cross-polar radiation pattern 412. The desired co-polar radiation pattern 411 is a toroid that provides omni-directional coverage in the azimuth plane (e.g., as defined by the x-axis and the y-axis) for vertically polarized signals (E⇑ ). The undesired cross-polar radiation pattern 412 may be described as a figure-8 pattern in the azimuth plane having maximum gains along the x-axis and having minimum gains (e.g., nulls) along the y-axis. The isolation between the desired co-polar radiation pattern 411 and the undesirable cross-polar radiation pattern 412 may be on the order of approximately between 13-14 dB, thereby allowing the vertically polarized first antenna 210 to receive vertically polarized signals with minimal interference from any inadvertently received horizontally polarized signals.

The radiation pattern 420 of the second antenna 220, which is horizontally polarized and is co-planar with the azimuth plane (e.g., as defined by the x-axis and the y-axis), includes a desired co-polar radiation pattern 421 and an undesirable cross-polar radiation pattern 422. The desired co-polar radiation pattern 421 is a toroid that provides omni-directional coverage in the azimuth plane for horizontally polarized signals (E⇔ ). The undesired cross-polar radiation pattern 422 may be described as a figure-8 pattern having maximum gains at approximately 120 degrees and 300 degrees, and having nulls at approximately 30 degrees and 210 degrees. The isolation between the desired co-polar radiation pattern 421 and the undesirable cross-polar radiation pattern 422 may be on the order of approximately 18 dB, thereby allowing the horizontally polarized second antenna 220 to receive horizontally polarized signals with minimal interference from any inadvertently received vertically polarized signals.

As described above with respect to FIGS. 2A-2C, the parasitic elements 211 and 231 may be excited and re-radiate electromagnetic waves radiated from the second antenna 220 to compensate for nulls in the radiation pattern of the second antenna 220. For example, without the parasitic elements 211 and 231, the co-planar radiation pattern 421 of the second antenna 220 may include nulls N1 and N2 (or at least areas of reduced gains) on either side of the second antenna 220, as depicted in FIG. 4B. The presence of parasitic elements 211 and 231 may compensate for nulls N1 and N2 by absorbing and re-radiating electromagnetic waves radiated from the second antenna 220, thereby resulting in the omni-directional radiation pattern 421 shown in FIG. 4B.

Figure 5A:
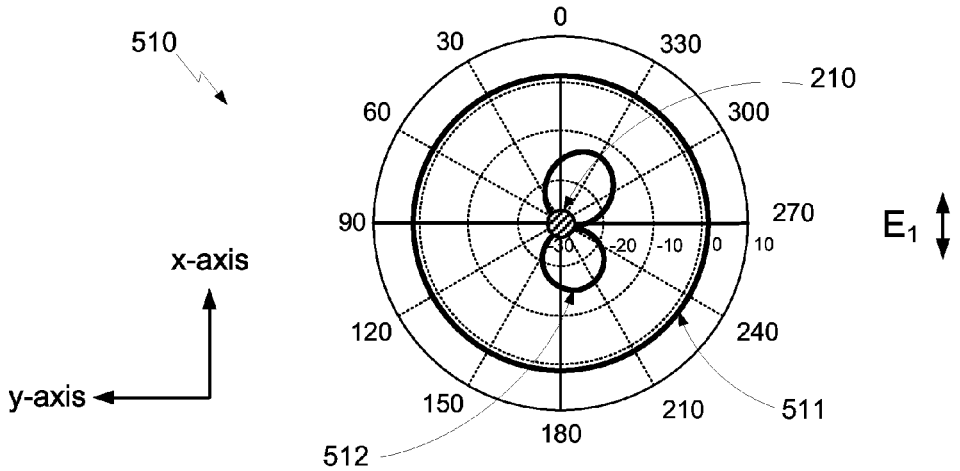
FIG. 5A depicts a radiation pattern of the first antenna of the antenna structure of FIGS. 2A-2C, at a third carrier frequency, in accordance with some embodiments.
Figure 5B:
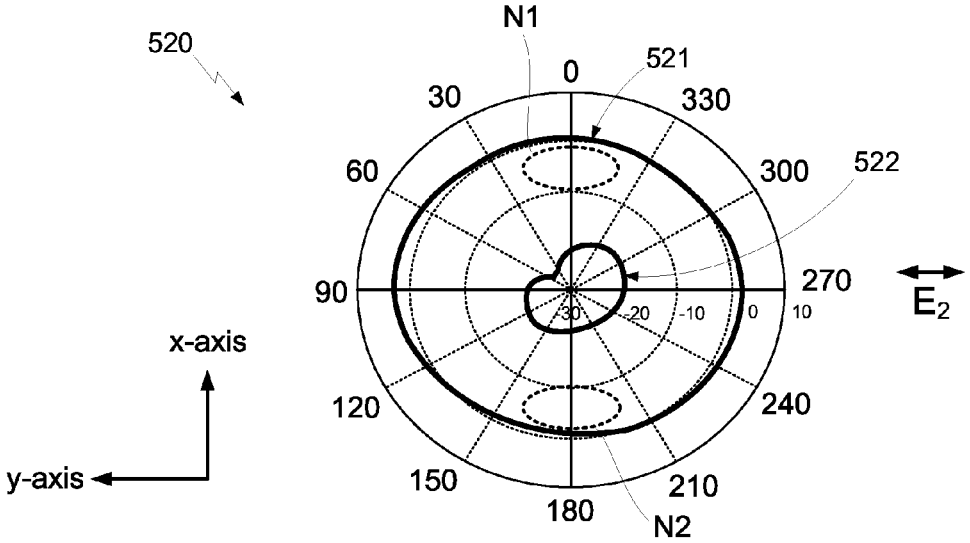
FIG. 5B depicts a radiation pattern of the first antenna of the antenna structure of FIGS. 2A-2C, at the third carrier frequency, in accordance with some embodiments.

FIG. 5A shows a cross-sectional view of a radiation pattern 510 of the first antenna 210 associated with a third carrier frequency of approximately 5.9 GHz, and FIG. 5B shows a cross-sectional view of a radiation pattern 520 of the second antenna 220 associated with the third carrier frequency of approximately 5.9 GHz. The radiation pattern 510 of first antenna 210, which is vertically polarized and is depicted in FIG. 5A as extending outwardly from the azimuth plane (e.g., along the z-axis), includes a desired co-polar radiation pattern 511 and an undesirable cross-polar radiation pattern 512. The desired co-polar radiation pattern 511 is a toroid that provides omni-directional coverage in the azimuth plane (e.g., as defined by the x-axis and the y-axis) for vertically polarized signals (E⇑ ). The undesired cross-polar radiation pattern 512 may be described as a figure-8 pattern in the azimuth plane having maximum gains along the x-axis and having minimum gains (e.g., nulls) along the y-axis. The isolation between the desired co-polar radiation pattern 511 and the undesirable cross-polar radiation pattern 512 may be on the order of approximately between 13-14 dB, thereby allowing the vertically polarized first antenna 210 to receive vertically polarized signals with minimal interference from any inadvertently received horizontally polarized signals.

The radiation pattern 520 of the second antenna 220, which is horizontally polarized and is co-planar with the azimuth plane (e.g., as defined by the x-axis and the y-axis), includes a desired co-polar radiation pattern 521 and an undesirable cross-polar radiation pattern 522. The desired co-polar radiation pattern 521 is a toroid that provides omni-directional coverage in the azimuth plane for horizontally polarized signals (E⇔ ). The undesired cross-polar radiation pattern 522 may be described as a cardioid having maximum gains at approximately 120 degrees and 300 degrees, and having a null at approximately 45 degrees. The isolation between the desired co-polar radiation pattern 521 and the undesirable cross-polar radiation pattern 522 may be on the order of approximately 18 dB, thereby allowing the horizontally polarized second antenna 220 to receive horizontally polarized signals with minimal interference from any inadvertently received vertically polarized signals.

As described above with respect to FIGS. 2A-2C, the parasitic elements 211 and 231 may be excited and re-radiate electromagnetic waves radiated from the second antenna 220 to compensate for nulls in the radiation pattern of the second antenna 220. For example, without the parasitic elements 211 and 231, the co-planar radiation pattern 521 of the second antenna 220 may include nulls N1 and N2 (or at least areas of reduced gains) on either side of the second antenna 220, as depicted in FIG. 5B. The presence of parasitic elements 211 and 231 may compensate for nulls N1 and N2 by absorbing and re-radiating electromagnetic waves radiated from the second antenna 220, thereby resulting in the omni-directional radiation pattern 521 shown in FIG. 5B.

Figure 6:
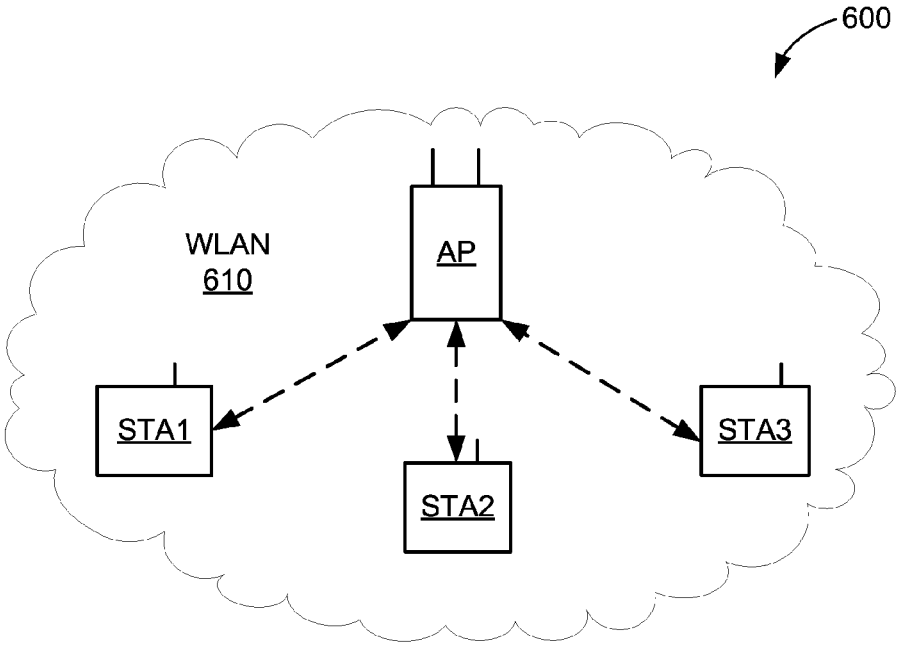
FIG. 6 shows a block diagram of a wireless network within which the present embodiments may be implemented.

As mentioned above, the antenna structure 200 of the present embodiments may be provided within wireless devices, for example, to provide MIMO functionality and/or to provide polarization diversity in all directions on the horizon. The wireless devices that employ antenna structure 200 of the present embodiments may include wireless access points, wireless stations, and/or other wireless communication devices. For example, FIG. 6 is a block diagram of a wireless network system 600 within which the present embodiments may be implemented. The system 600 is shown to include three wireless stations (STA1, STA2, STA3), a wireless access point (AP), and a wireless local area network (WLAN) 610. In one embodiment, the WLAN 610 may be formed by a plurality of Wi-Fi access points (APs) that may operate according to various IEEE 802.11 standards (or according to other suitable wireless protocols). Although only one AP and three STAs are shown in FIG. 6 for simplicity, it is to be understood that WLAN 610 may be formed by any number of access points and/or stations.

The stations STA1-STA3 may be any suitable Wi-Fi enabled wireless devices including, for example, network-enabled sensors, memory tags (RFID tags), smart meters, cell phones, personal digital assistants (PDAs), tablet devices, laptop computers, or the like. For at least some embodiments, stations STA1-STA3 may include a transceiver circuit, one or more processing resources, one or more memory resources, and a power source (e.g., battery). The memory resources may include a non-transitory computer-readable medium (e.g., one or more nonvolatile memory elements, such as EPROM, EEPROM, Flash memory, a hard drive, etc.) that stores instructions for performing a variety of different operations.

The AP may be any suitable device that allows one or more wireless devices to connect to a network (e.g., a LAN, WAN, MAN, and/or the Internet) via the AP using Wi-Fi, Bluetooth, or any other suitable wireless communication standards. For at least one embodiment, the AP may include a transceiver circuit, one or more processing resources (e.g., a baseband processor), and one or more memory sources. The memory resources may include a non-transitory computer-readable medium (e.g., one or more nonvolatile memory elements, such as EPROM, EEPROM, Flash memory, a hard drive, etc.) that stores instructions for performing a variety of different operations.

Figure 7:
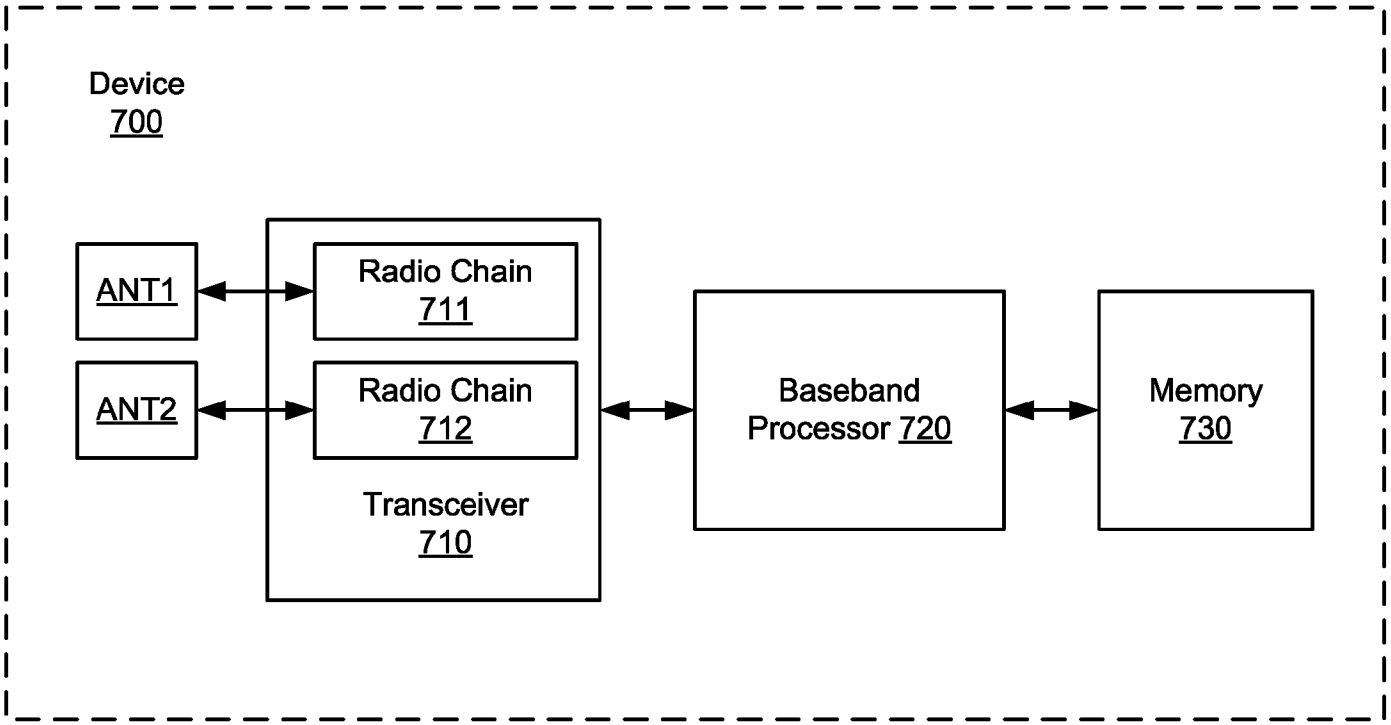
FIG. 7 shows a block diagram of a wireless communication device within which the present embodiments may be implemented.

FIG. 7 shows a block diagram of a wireless communication device 700 in accordance with some embodiments. The wireless communication device 700 may include a plurality of antenna structures, which in turn may be formed using one or more antenna structures 200 described above. The exemplary device 700 of FIG. 7 is shown to include a transceiver 710, a baseband processor 720, a memory 730, and two antenna structures ANT1-ANT2. Transceiver 710 is shown to include two radio chains 711-712, where first radio chain 711 is coupled to first antenna structure ANT1 and second radio chain 712 is coupled to second antenna structure ANT2. Although only two antenna structures ANT1-ANT2 and two radio chains 711-712 are depicted in FIG. 7, additional antenna structures and/or additional radio chains may be provided. Further, although radio chains 711 and 712 are depicted in the exemplary embodiment of FIG. 7 as being coupled to respective antenna structures ANT1 and ANT2, for other embodiments, device 700 may include switching circuitry (not shown for simplicity) that may allow each of radio chains 711 and 712 to be selectively coupled to either or both of antenna structures ANT1 and ANT2.

For some embodiments, the transceiver 710 may select (e.g., via a switch and other circuitry) either the first antenna 210 or the second antenna 220 of the corresponding antenna structure ANT1 or ANT2 for transmission or reception of RF signals. For other embodiments, the transceiver 710 may transmit/receive the same signals to/from both the first antenna 210 and the second antenna 220 of the corresponding antenna structure 200 for transmission or reception of RF signals. Because the first antenna 210 and the second antenna 220 of each of antenna structures ANT1-ANT2 200 may provide vertical polarization and horizontal polarization, respectively, for all angles in the azimuth plane, full polarization diversity may be achieved for MIMO performance in the device 700.

The transceiver 710 may be used to communicate with other wireless communication devices or a WLAN server (not shown) associated with WLAN 610 of FIG. 6 either directly or via one or more intervening networks. The baseband processor 720, which is coupled to transceiver 710 and to memory 730, may be any suitable processor capable of executing scripts or instructions of one or more software programs stored in the device 700 (e.g., within memory 730). The baseband processor 720 may manage radio functions for the device 700 (e.g., to generate signals to be transmitted from device 700 and/to process signals received by device 700). Memory 730 may include a non-transitory computer-readable medium (e.g., one or more nonvolatile memory elements, such as EPROM, EEPROM, Flash memory, a hard drive, etc.) that may store instructions executed by the baseband processor 720.

Figure 8:
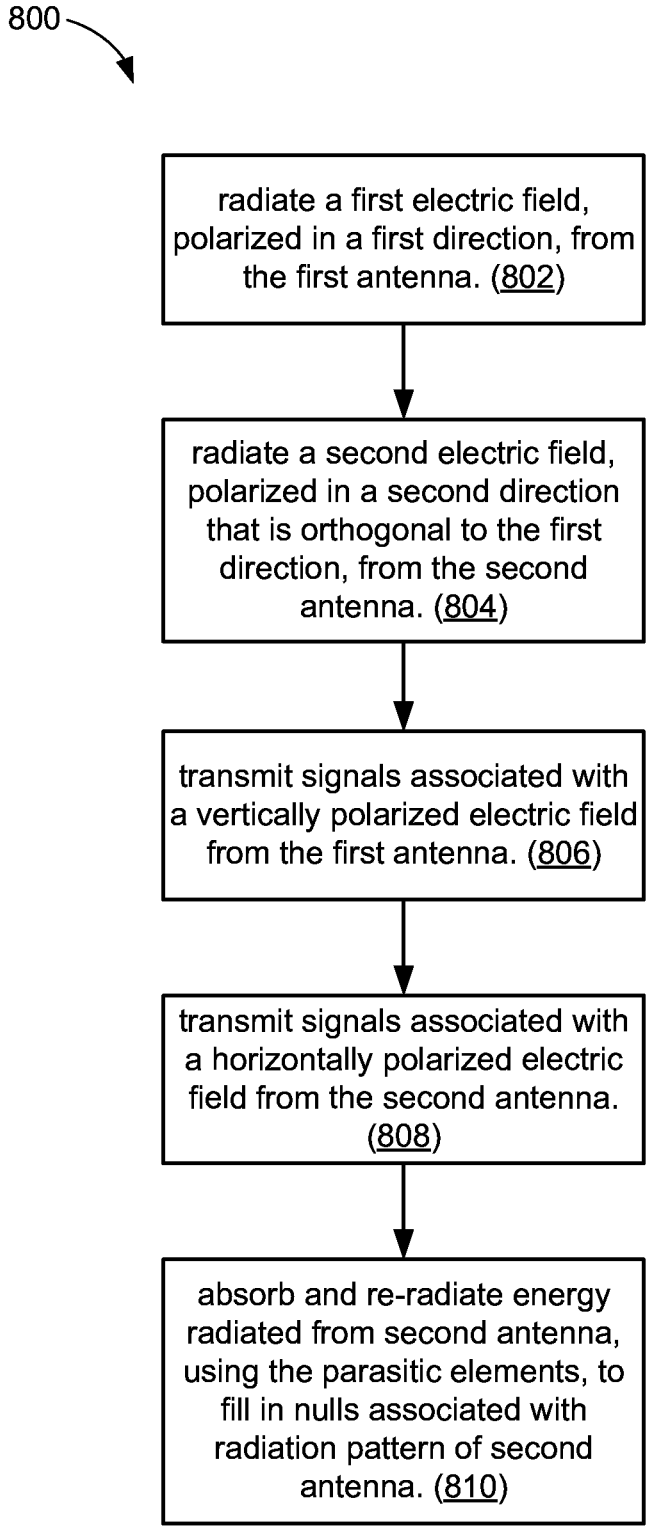
FIG. 8 is a flow chart depicting an exemplary operation of an antenna structure in accordance with some embodiments.

FIG. 8 is an illustrative flow chart 800 that depicts an exemplary operation performed using one or more of antenna structures 200 in accordance with some embodiments. Although the operation of flow chart 800 is described below with respect to FIGS. 2A-2C for simplicity, the operation of flow chart 800 may also be applicable to other embodiments of the present disclosure. For example, to transmit a signal from device 700 of FIG. 7 using antenna structure 200 of FIGS. 2A-2C, the first antenna 210 radiates a first electric field that is polarized in a first direction (802), and the second antenna 220 radiates a second electric field that is polarized in a second direction that is orthogonal to the first direction (804). As mentioned above, for some embodiments, the first antenna 210 may radiate a vertically polarized electric field, and the second antenna 220 may radiate a horizontally polarized electric field.

Thereafter, the first antenna 210 may transmit signals associated with a vertically polarized electric field (806), and the second antenna 220 may transmit signals associated with a horizontally polarized electric field (808). As described above, the first antenna 210 may be characterized by a first radiation pattern that is omni-directional in an azimuth plane of the Earth, and the second antenna 220 may be characterized by a second radiation pattern that is omni-directional in the azimuth plane. For at least some embodiments, the first and second parasitic elements 211 and 231 may absorb and re-radiate energy (e.g., electromagnetic waves) radiated from the second antenna 220, for example, in a manner that may fill in nulls N1 and N2 in the radiation pattern of the second antenna 220 that lie alongside the first and second parasitic elements 211 and 231, for example, as described above with respect to FIGS. 3B, 4B, and 5B (810).

For example, some embodiments may include a method of operating a communication device including an antenna structure that includes a first antenna extending from a substrate in a vertical direction, a second antenna formed on the substrate, a first parasitic element formed on the substrate, and a second parasitic element formed on the substrate, the method comprising: radiating a vertically polarized electric field at all angles in an azimuth plane from the first antenna; radiating a horizontally polarized electric field at all angles in the azimuth plane from the second antenna; absorbing, into the first and second parasitic elements, electromagnetic waves radiated from the second antenna; and re-radiating the electromagnetic waves from the first and second parasitic elements. The method may further comprise: transmitting signals associated with the vertically polarized electric field from the first antenna; and transmitting signals associated with the horizontally polarized electric field from the second antenna. For at least one embodiment, the second antenna, the first parasitic element, and the second parasitic element are coplanar with the substrate. For at least one embodiment, the second antenna comprises a first radiating element formed on a top surface of the substrate; and a second radiating element formed on a bottom surface of the substrate. For at least one embodiment, the first radiating element comprises a first pair of substantially L-shaped radiating bodies electrically coupled to each other at a first terminal of the second antenna; and the second radiating element comprises a second pair of substantially L-shaped radiating bodies electrically coupled to each other at a second terminal of the second antenna.

Figure 9:
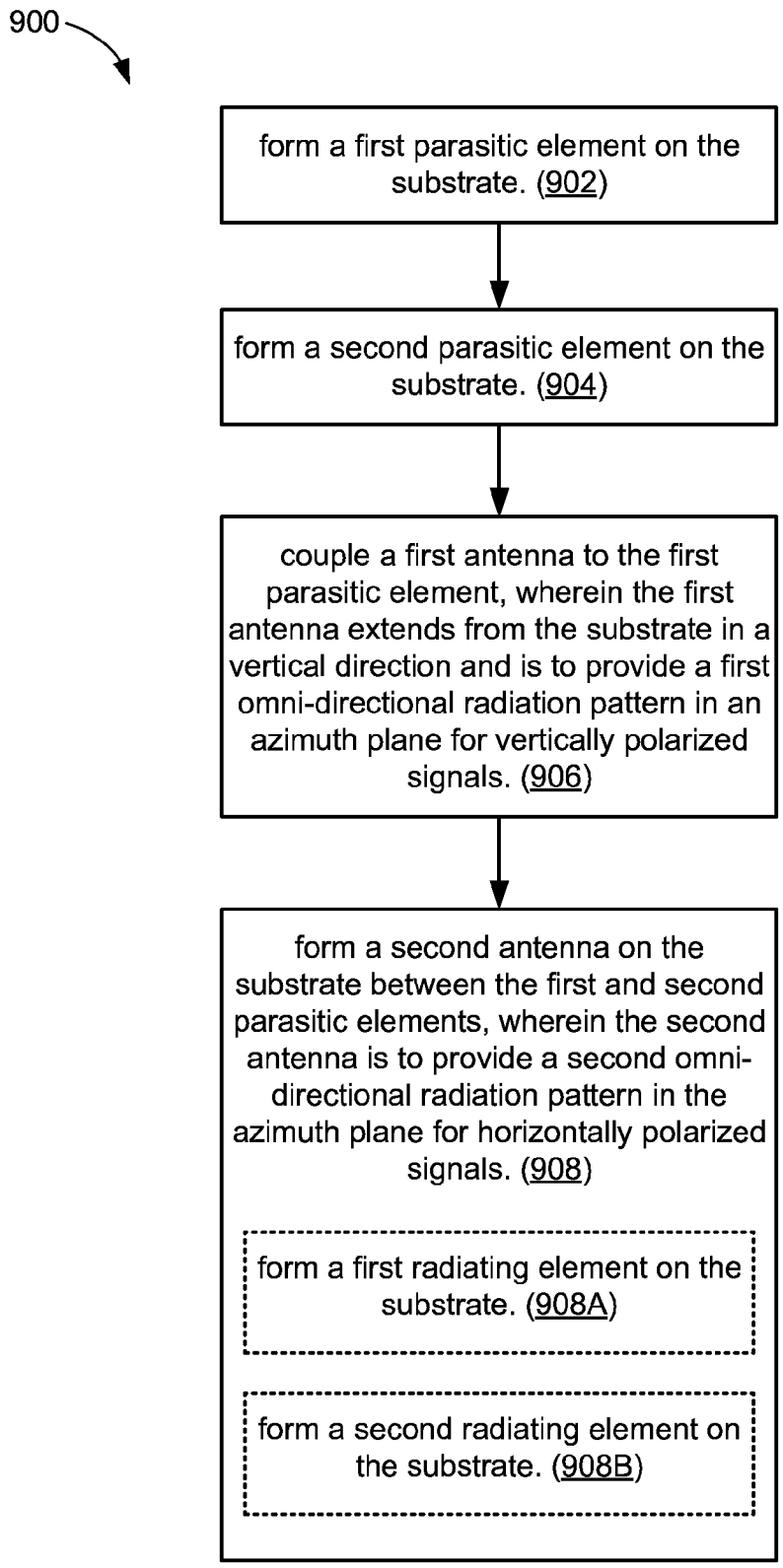
FIG. 9 is a flow chart depicting an exemplary operation for constructing antenna structures in accordance with some embodiments.

FIG. 9 is an illustrative flow chart 900 that depicts an exemplary operation for constructing the antenna structures 200 in accordance with some embodiments. Although the operation of flow chart 900 is described below with respect to FIGS. 2A-2C for simplicity, the operation of flow chart 900 may also be applicable to other embodiments of the present disclosure. For example, to construct the antenna structure 200, a manufacturer may form the first parasitic element 211 on the substrate 205 (902), and may then form the second parasitic element 231 on the substrate 205 (904). Next, the manufacturer may couple the first antenna 210 to the first parasitic element 211, wherein the first antenna 210 extends from the substrate 205 in a vertical direction and is to provide a first omni-directional radiation pattern in an azimuth plane for vertically polarized signals (906). Then, the manufacturer may form the second antenna 220 on the substrate 205 between the first and second parasitic elements 211 and 231, wherein the second antenna 220 is to provide a second omni-directional radiation pattern in the azimuth plane for horizontally polarized signals (908). For at least some embodiments, the second antenna 220 may be formed by forming the first radiating element 221 on the substrate 205 (908A), and by forming the second radiating element 222 on the substrate (908B.)

In the foregoing specification, the present embodiments have been described with reference to specific exemplary embodiments thereof. It will, however, be evident that various modifications and changes may be made thereto without departing from the broader scope of the disclosure as set forth in the appended claims. The specification and drawings are, accordingly, to be regarded in an illustrative sense rather than a restrictive sense. For example, for other embodiments, parasitic elements 211 and/or 231 may be omitted, or additional parasitic elements may be added.

What is claimed is:

1. An antenna structure, comprising:

a substrate oriented in an azimuth plane;

a first parasitic element formed on the substrate;

a second parasitic element formed on the substrate;

a first antenna coupled to the first parasitic element and extending from the substrate in a vertical direction, wherein the first antenna is to provide a first omni-directional radiation pattern in the azimuth plane for vertically polarized signals, wherein the first parasitic element comprises a ground plane of the first antenna; and a second antenna formed on the substrate and including a first radiating element, a second radiating element, the first parasitic element, and the second parasitic element, wherein the second antenna is to provide a second omni-directional radiation pattern in the azimuth plane for horizontally polarized signals shaped, at least in part, by the first and the second parasitic elements, and wherein the first and the second parasitic elements are electrically isolated from the first and the second radiating elements.

2. The antenna structure of claim 1, wherein the first radiating element is formed on a top surface of the substrate, and the second radiating element is formed on a bottom surface of the substrate.

3. The antenna structure of claim 1, wherein:

the first radiating element comprises a first pair of substantially L-shaped radiating bodies electrically coupled to each other at a first terminal of the second antenna; and the second radiating element comprises a second pair of substantially L-shaped radiating bodies electrically coupled to each other at a second terminal of the second antenna.

4. The antenna structure of claim 3, wherein:

each of the substantially L-shaped radiating bodies of the first radiating element comprises a flared end portion; and each of the substantially L-shaped radiating bodies of the second radiating element comprises a flared end portion.

5. The antenna structure of claim 1, wherein:

a main portion of the first radiating element is positioned parallel to and substantially equidistant from the first and second parasitic elements;

a main portion of the second radiating element is positioned parallel to and substantially equidistant from the first and second parasitic elements; and the main portion of the first radiating element overlies the main portion of the second radiating element.

6. The antenna structure of claim 1, further comprising:

a first feed point including a first terminal coupled to the first antenna and including a second terminal coupled to the first parasitic element; and a second feed point including a first terminal coupled to the first radiating element and including a second terminal coupled to the second radiating element.

7. The antenna structure of claim 1, wherein both the first and second parasitic elements are magnetically coupled to the first and the second radiating elements.

8. The antenna structure of claim 1, wherein the first and second parasitic elements are to absorb and re-radiate electromagnetic waves radiated from the first and the second radiating elements.

9. The antenna structure of claim 1, wherein the first and second parasitic elements are to fill nulls in the second omnidirectional radiation pattern, of the second antenna, that lie alongside the first and second parasitic elements.

10. The antenna structure of claim 1, wherein the first antenna and the second antenna are to concurrently transmit a first data stream and a second data stream.

11. A method of constructing an antenna structure that includes a substrate, the method comprising:

forming a first parasitic element on the substrate;

forming a second parasitic element on the substrate;

coupling a first antenna to the first parasitic element, wherein the first antenna extends from the substrate in a vertical direction and is to provide a first omni-directional radiation pattern in an azimuth plane for vertically polarized signals, wherein the first parasitic element comprises a ground plane of the first antenna; and forming a second antenna on the substrate and including a first radiating element, a second radiating element, the first parasitic element and the second parasitic element, wherein the second antenna is to provide a second omni-directional radiation pattern in the azimuth plane for horizontally polarized signals shaped, at least in part, by the first and the second parasitic elements, and wherein the first parasitic element and the second parasitic elements are electrically isolated from the first and the second radiating elements.

12. The method of claim 11, wherein the first and second parasitic elements are to fill nulls in the second omni-directional radiation pattern, of the second antenna, that lie alongside the first and second parasitic elements.

13. The method of claim 11, wherein forming the second antenna comprises:

forming the first radiating element on the substrate, and forming the second radiating element on the substrate.

14. The method of claim 11, wherein:

the first radiating element comprises a first pair of substantially L-shaped radiating bodies electrically coupled to each other at a first terminal of the second antenna; and the second radiating element comprises a second pair of substantially L-shaped radiating bodies electrically coupled to each other at a second terminal of the second antenna.

15. The method of claim 11, wherein the first antenna and the second antenna are formed to concurrently transmit a first data stream and a second data stream.

16. A communication device, comprising:

a radio chain; and an antenna structure coupled to the radio chain, the antenna structure comprising:

a substrate oriented in an azimuth plane;

a first parasitic element formed on the substrate;

a second parasitic element formed on the substrate;

a first antenna coupled to the first parasitic element and extending from the substrate in a vertical direction, wherein the first antenna is to provide a first omni-directional radiation pattern in the azimuth plane for vertically polarized signals, wherein the first parasitic element comprises a ground plane of the first antenna; and a second antenna formed on the substrate and including a first radiating element, a second radiating element, the first parasitic element and the second parasitic element, wherein the second antenna is to provide a second omni-directional radiation pattern in the azimuth plane for horizontally polarized signals shaped, at least in part, by the first and the second parasitic elements, and wherein the first and the second parasitic elements are electrically isolated from the first and the second radiating elements.

17. The communication device of claim 16, wherein:

the first radiating element formed on a top surface of the substrate and including a first pair of substantially L-shaped radiating bodies electrically coupled to each other at a first terminal of the second antenna, and the second radiating element formed on a bottom surface of the substrate and including a second pair of substantially L-shaped radiating bodies electrically coupled to each other at a second terminal of the second antenna.

18. The communication device of claim 16, wherein:

a main portion of the first radiating element is positioned parallel to and substantially equidistant from the first and second parasitic elements;

a main portion of the second radiating element is positioned parallel to and substantially equidistant from the first and second parasitic elements; and the main portion of the first radiating element overlies the main portion of the second radiating element.

19. The communication device of claim 16, further comprising:

a first feed point including a first terminal coupled to the first antenna and including a second terminal coupled to the first parasitic element; and a second feed point including a first terminal coupled to the first radiating element and including a second terminal coupled to the second radiating element.

20. The communication device of claim 16, wherein both the first and second parasitic elements are magnetically coupled to the first and the second radiating elements.

21. The communication device of claim 16, wherein the first and second parasitic elements are to absorb and re-radiate electromagnetic waves radiated from the first and the second radiating elements.

22. The communication device of claim 16, wherein the first and second parasitic elements are to fill nulls in the second omni-directional radiation pattern, of the second antenna, that lie alongside the first and second parasitic elements.

23. The communication device of claim 16, wherein the first antenna and the second antenna are to concurrently transmit a first data stream and a second data stream.

* * * * *